US011363838B1

(12) United States Patent
Boen

(10) Patent No.: US 11,363,838 B1
(45) Date of Patent: Jun. 21, 2022

(54) ICE WATER PIPE

(71) Applicant: William Carl Boen, Superior, CO (US)

(72) Inventor: William Carl Boen, Superior, CO (US)

( * ) Notice: Subject to any disclaimer, the term of this patent is extended or adjusted under 35 U.S.C. 154(b) by 300 days.

(21) Appl. No.: 16/453,551

(22) Filed: Jun. 26, 2019

Related U.S. Application Data

(60) Provisional application No. 62/690,490, filed on Jun. 27, 2018.

(51) Int. Cl.
*A24F 1/30* (2006.01)
*F25C 1/04* (2018.01)
*A24F 3/00* (2006.01)

(52) U.S. Cl.
CPC ..... *A24F 1/30* (2013.01); *A24F 3/00* (2013.01); *F25C 1/04* (2013.01)

(58) Field of Classification Search
None
See application file for complete search history.

(56) References Cited

U.S. PATENT DOCUMENTS 3,882,875 A * 5/1975 Frost ..... A24F 1/30 131/173
2015/0342250 A1* 12/2015 Hoch ..... A24F 7/02 131/328
2018/0043605 A1* 2/2018 Bischer ..... B29C 49/62

* cited by examiner

*Primary Examiner* — Michael J Felton
*Assistant Examiner* — Katherine A Will
(74) *Attorney, Agent, or Firm* — Superior Patent Group, LLC; Patricia C. Brzostowicz

(57) ABSTRACT

A water pipe is made of ice from a flexible mold. The mold has a central main sheath to form a central smoke channel in the ice pipe. A core plug is placed in the central main sheath to prevent a collapse of the central main sheath during the freeze process. A bulkhead projects from the side of the mold which has a smoke channel therein. A smoke sheath intersects with the central main sheath to form a smoke channel from a bowl on the smoke channel inlet up the central smoke channel. The ice pipe is placed on a tray having an associated LED entertainment light so as to light up the ice pipe during use.

13 Claims, 13 Drawing Sheets

ICE WATER PIPE

CROSS REFERENCE APPLICATIONS

This non-provisional application claims priority to provisional application Ser. No. 62/690,490 filed Jun. 27, 2018 which is incorporated herein by reference in its entirety.

FIELD OF INVENTION

The present invention relates to providing a flexible mold that is filled with water to form a frozen water pipe with a main vertical opening and a smoke opening on the side and a mouthpiece on the top.

BACKGROUND OF THE INVENTION

Eyce, LLC, Colorado Springs, Colo. has a commercialized ice water pipe described in Pub. No. US 2015/0342250, published Dec. 3, 2015. A water pipe includes a body including ice. The body includes a hollowed interior configured for being filled with water and an opening at a side of the body. The water pipe further includes a base coupled to a bottom of the body, a mouthpiece coupled to a top of the body, and a grommet coupled to a circumference of the body. The grommet is further coupled to the body through a hollowed stem inserted into an opening of the grommet and the opening at the side of the body. A top of the base comprises one or more fingers coupled to the ice of the body. An under body of the mouthpiece includes a cored out body and one or more fingers coupled to the ice of the body. The grommet includes a flexible material configured to stay coupled to the body as the ice of the body melts or deforms. The base includes an opening configured to be filled by a plug. The plug includes a flexible material. The body further includes one or more of a scent, a flavor, and a food. The body further includes one or more of a color, a design, and an ornament.

What is needed in the art is an ice water pipe mold that allows a prior art glass smoking bowl to insert directly into the ice pipe side hole. Also needed is a catch basin tray to catch the melting ice water. Also needed is an entertainment light associated with the catch basin tray to provide a visual light show while smoking.

The present invention provides all these features and more.

SUMMARY OF THE INVENTION

The main aspect of the present invention is to provide a catch basin with an associated battery powered LED light display for an ice pipe.

Another aspect of the present invention is to provide a side mount hole in the ice pipe to receive a rubber collar (bowl adapter) and a prior art glass bowl.

The sheath and plug combination is unique of which it creates a hole in a block of ice without cracking the block of ice itself. Usually when items are placed in water and frozen to create spaces, the overall block of ice will crack upon the removal of the item. This is mainly due to the natural properties of ice as ice expands when forming. The sheath plug combination works in the following manner: Assemble mold with mouthpiece sheaths and plug units. Add ater. Freeze. Remove plug. Then remove sheaths. By having the plug in the sheath it allows the ice block to free e with the plug/sheath unit retaining the overall shape. The plug is removed and then the sheath can collapse or conform in a manner to ease the removal of the sheath without cracking the ice block. The final product is a hole in a non-cracked block of ice.

The bowl adapter allows the bowl to constantly keep a se by having the bowl adapter conform to the ice block as it melts. This allows for proper operation f the ice water pipe.

Other aspects of this invention will appear from the following description and appended claims, reference being made to the accompanying drawings forming a part of this specification wherein like reference characters designate corresponding parts in the several views.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DETAILED DESCRIPTION OF THE DRAWINGS

Figure 1:
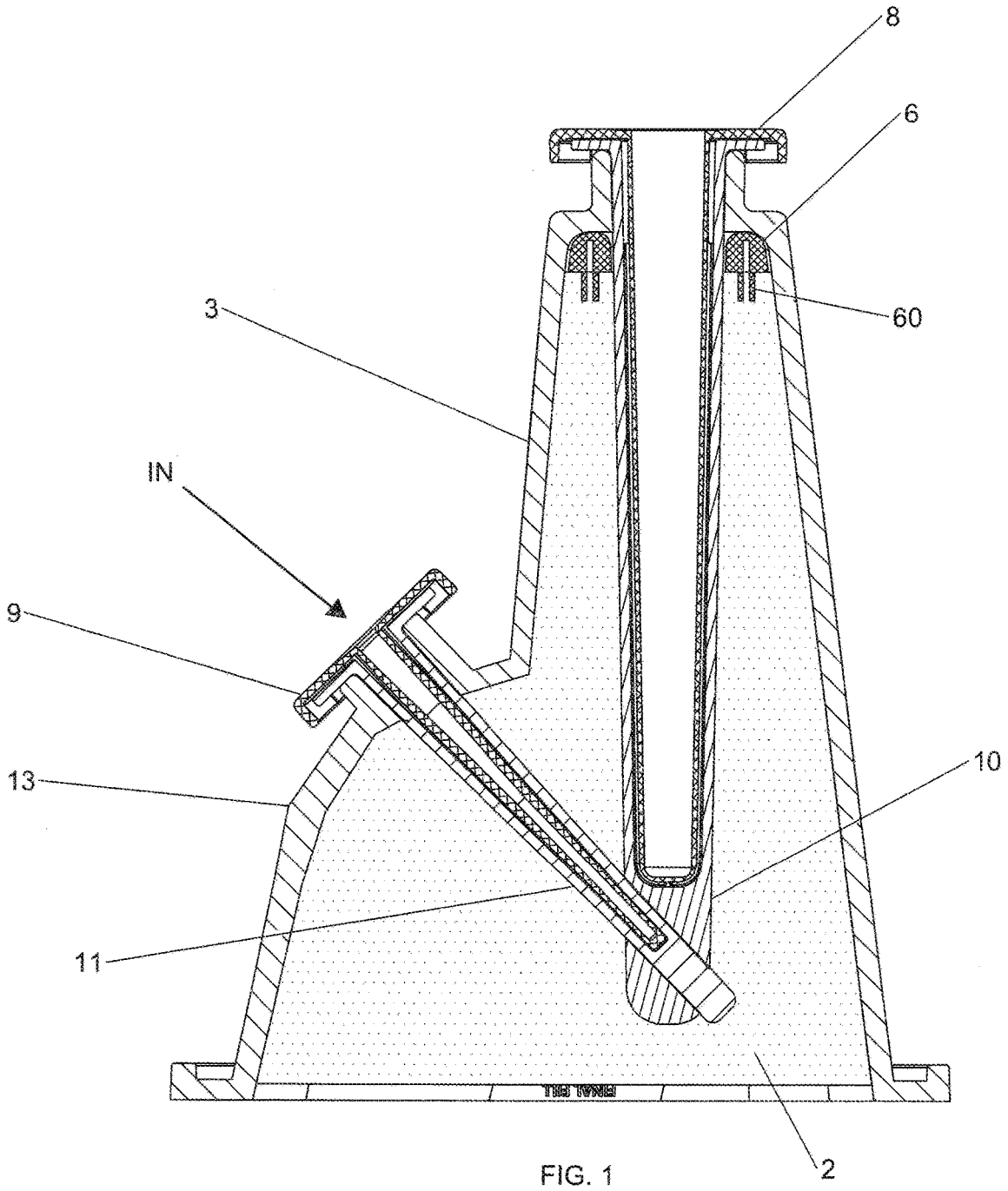
FIG. 1 is a longitudinal sectional view of the pipe mold and ice pipe.
Figure 2:
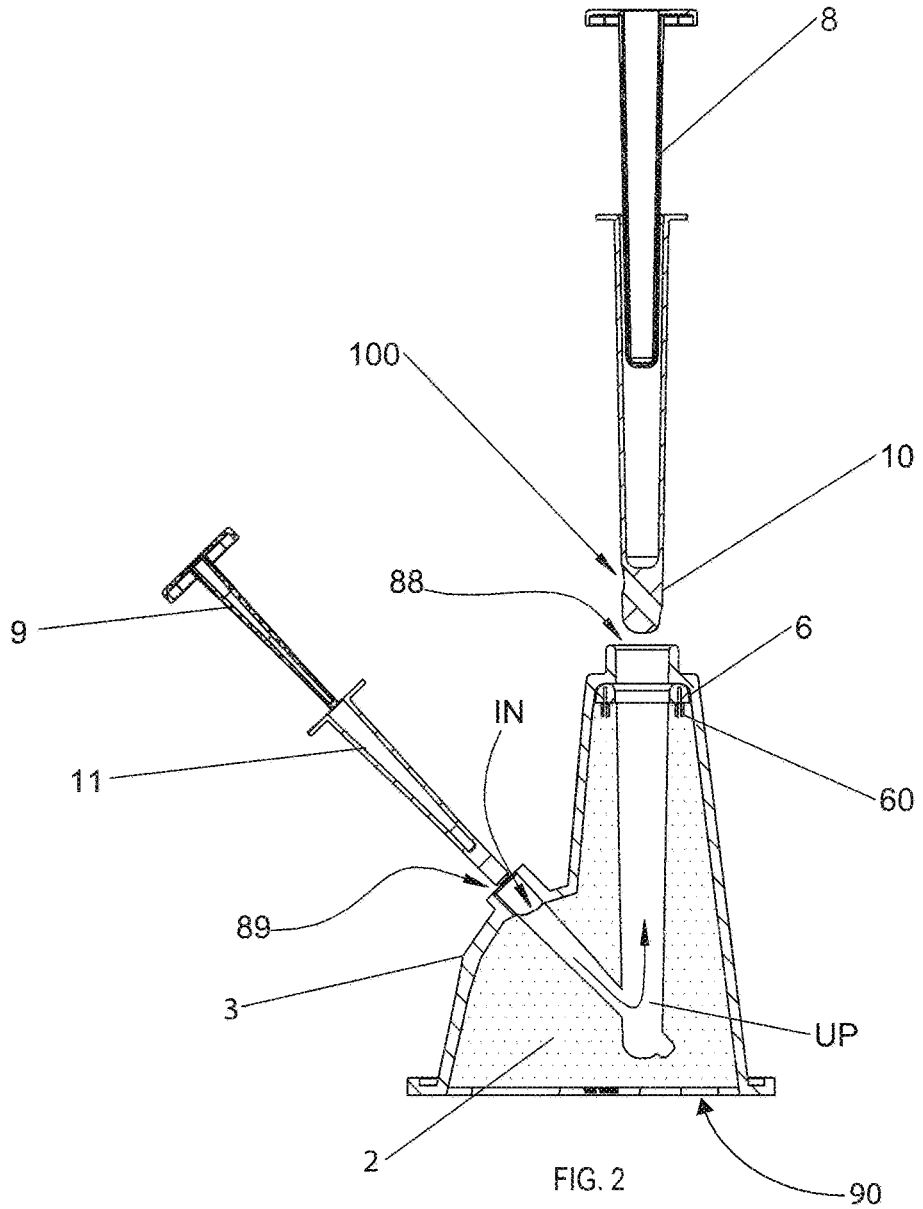
FIG. 2 is an exploded view of FIG. 1.

Referring first to FIGS. 1,2 the flexible ice pipe mold 3 has a hollow depending main sheath 10 that receives a solid or rigid (plastic) core plug 8. A smoke bulkhead 13 has a flexible sheath 11 that receives a (plastic) smoke insert 9. A plastic mouth piece 6 fits on top of the ice pipe mold 3 so as to remain on the ice pipe 2 when the mold 3 is removed. Teeth 60 on the mouthpiece 6 help keep the mouthpiece 6 attached to the ice pipe 2. Smoke travels from the bowl B shown in FIG. 4 as shown by arrow IN down the hollow in sheath 11 (FIG. 1) (also called a smoke channel insert) and up the hollow in the main sheath 10 (FIG. 1) shown by arrow UP. The ice pipe mold 3 is rubberlike which could be a silicone or a rubber or a flexible plastic.

The core plug 8 is preferably a hard plastic. The sheath 11 is inserted into the main sheath 10 at hole 100 after the main sheath 10 is inserted into the top hole 88 of the ice pipe mold 3. The core plug 8 is then inserted into the main sheath 10. The sheath 11 is inserted into hole 89. The smoke insert 9 is then inserted into the sheath 11.

The ice pipe mold 3 is placed upside down in a freezer. See FIG. 11. Water is poured to the first fill line into the base hole 90 and then frozen. Then more water is added to the final fill line and frozen to form a smoother bottom. When frozen the core plug 8 and smoke insert 11 are removed. The ice pipe 2 is removed from the ice pipe mold 3. The rubber collar 7 and (glass or plastic or ceramic) bowl B (see FIG. 4) are inserted. Optionally the ice pipe 2 is placed on tray 12 over the stand 1001. An LED light 1003 can be placed in hole 1002 to light up the ice pipe 2. A known remote controller 1004 can control the LED light 1003. Protrusions 1005 help hold the ice pipe 2 in place. See FIG. 10.

Figure 3:
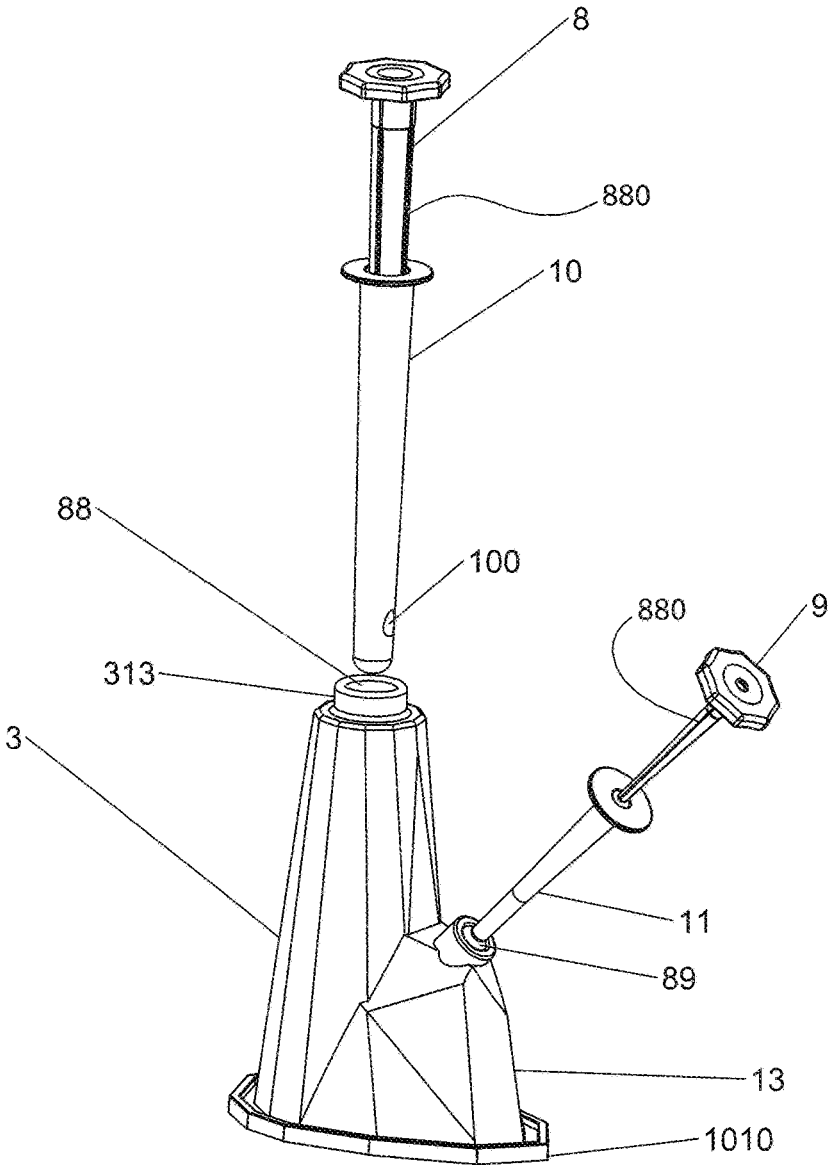
FIG. 3 is an exploded view of the mold.

Referring next to FIG. 3 the core plug 8 and smoke insert 9 have longitudinal grooves 880 to prevent an air lock and are hollow. The ice pipe mold 3 has a base ledge 1010. A top collar 313 surrounds the top hole 88.

Figure 4:
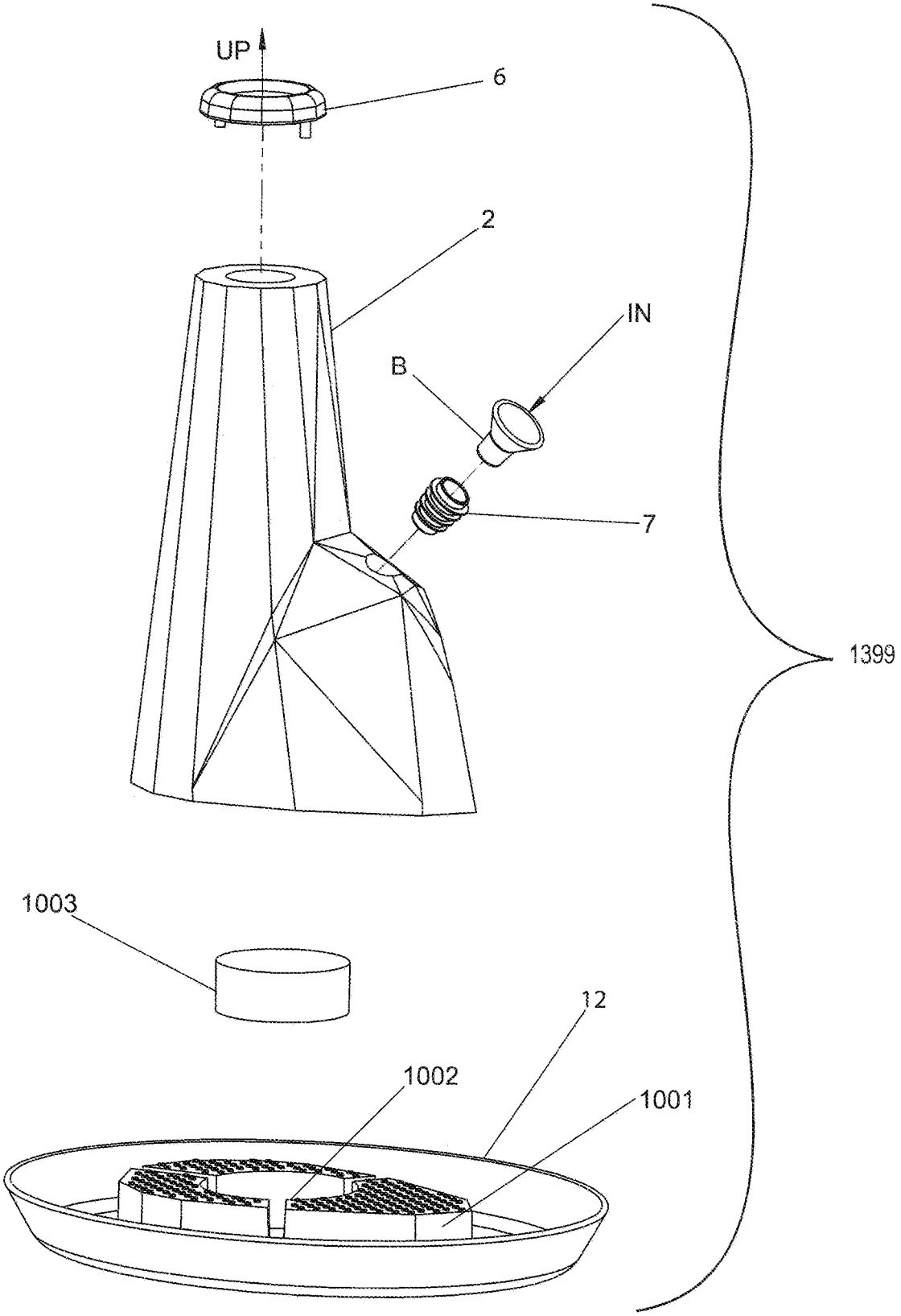
FIG. 4 is a front perspective view of the ice pipe ready for use in the tray.
Figure 13:
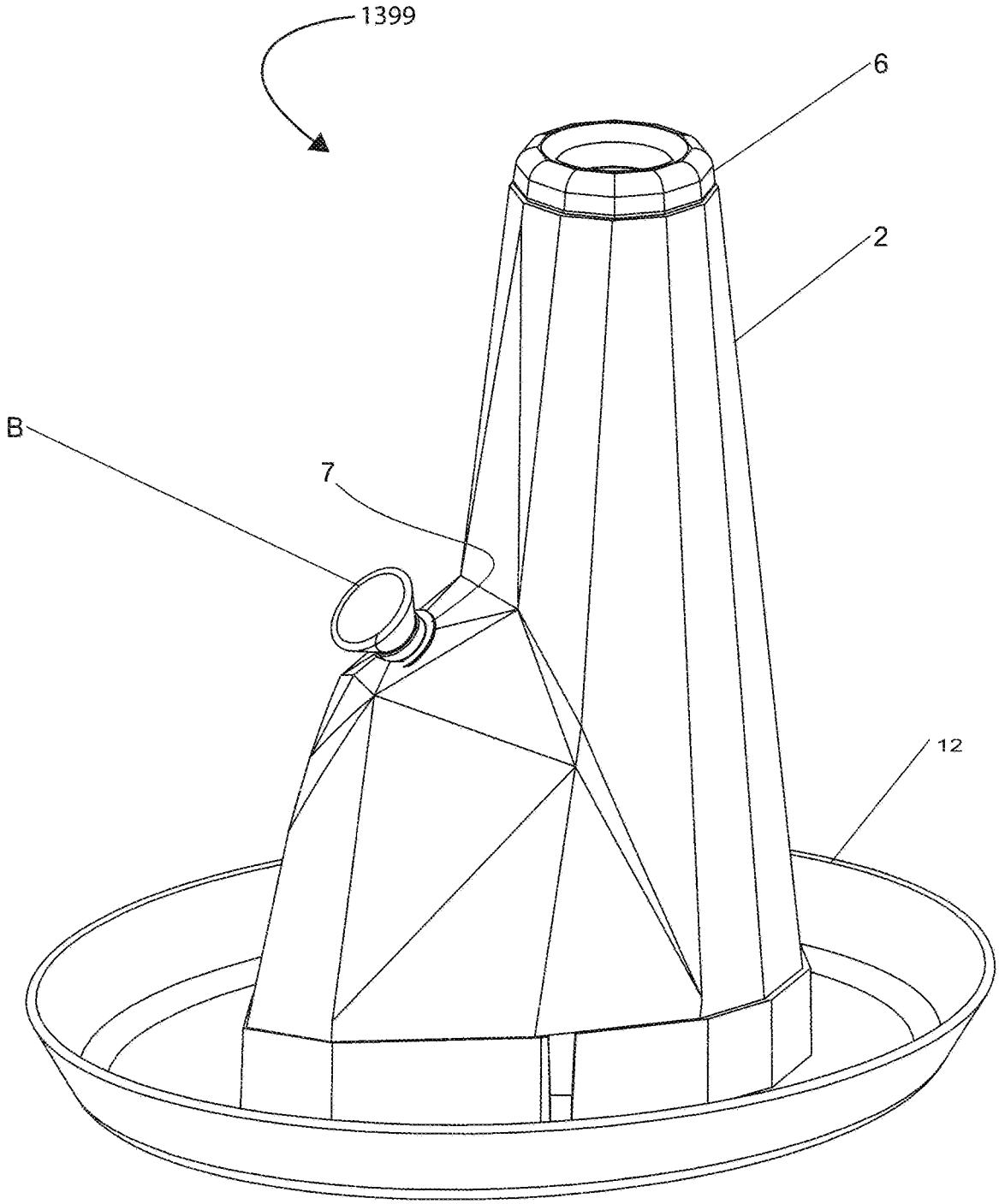
FIG. 13 is a side perspective view of the ice pipe of FIG. 4 assembled.

Referring next to FIG. 4 the ice pipe 2 is ready for use. The smoke travels in direction UP as tobacco and/or the herbal material burns in bowl B. FIG. 13 shows the assembled invention denoted 1399.

Figure 5:
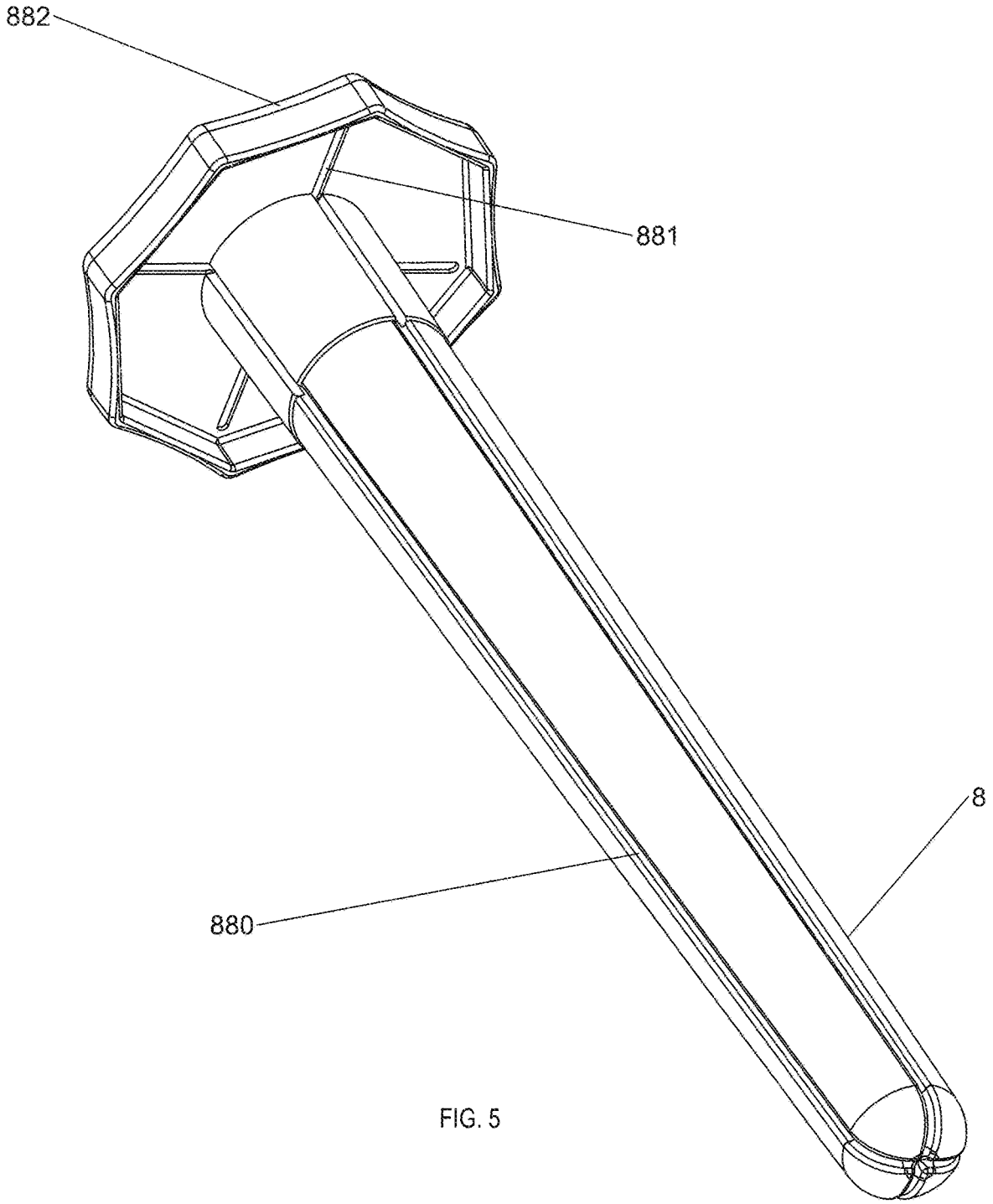
FIG. 5 is a bottom perspective view of the (plastic) core plug.

In FIG. 5 the core plug 8 has air vents (longitudinal grooves) 880, and its top 882 has air vents 881 to prevent a vacuum lock.

Figure 6:
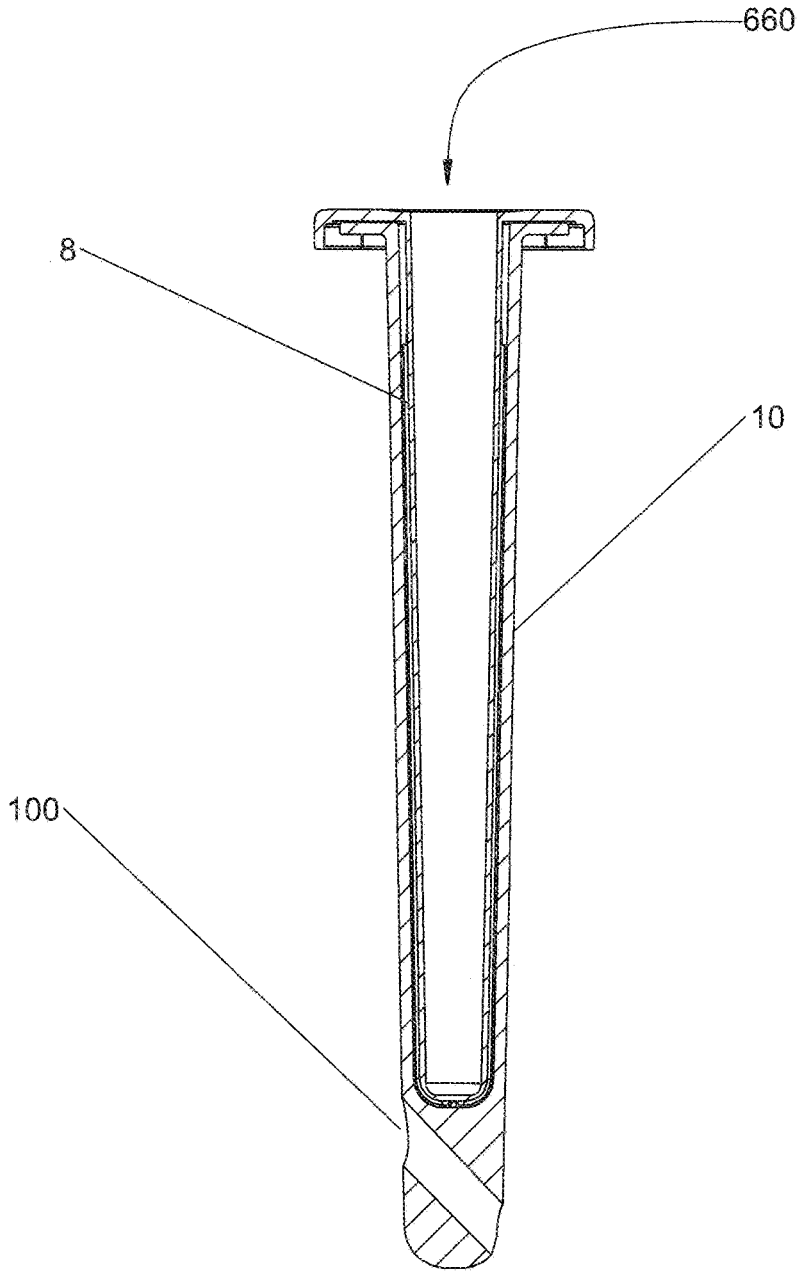
FIG. 6 is a longitudinal sectional view of the flexible main sheath.

In FIG. 6 the main sheath 10 is shown in a sectional view showing its top hole 660 that receives the core plug 8.

Figure 7:
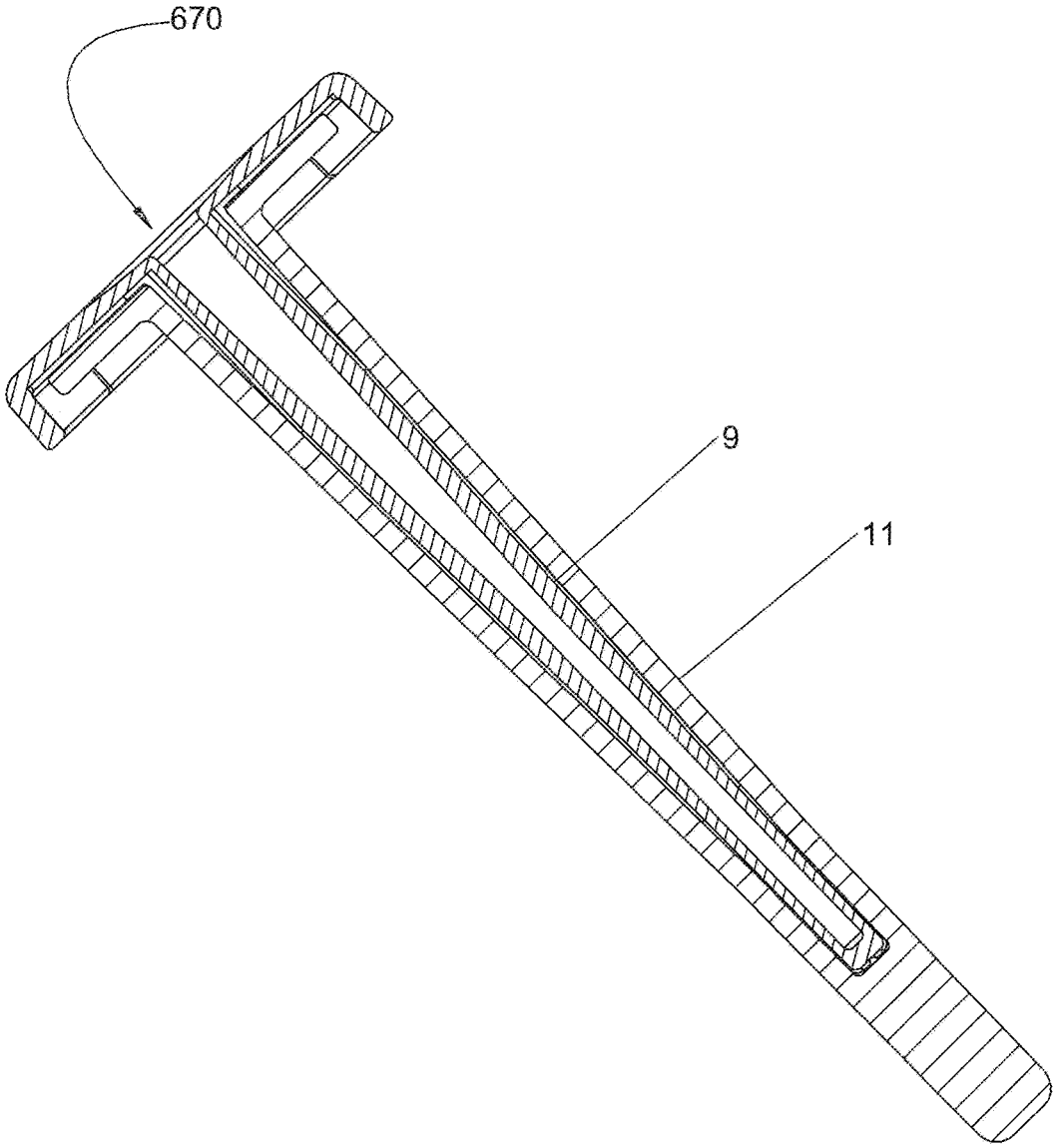
FIG. 7 is a longitudinal sectional view of the smoke mold and (plastic) insert.

In FIG. 7 the sheath 11 is shown in a sectional view showing its top hole 670 that receives the smoke insert 9.

Figure 8:
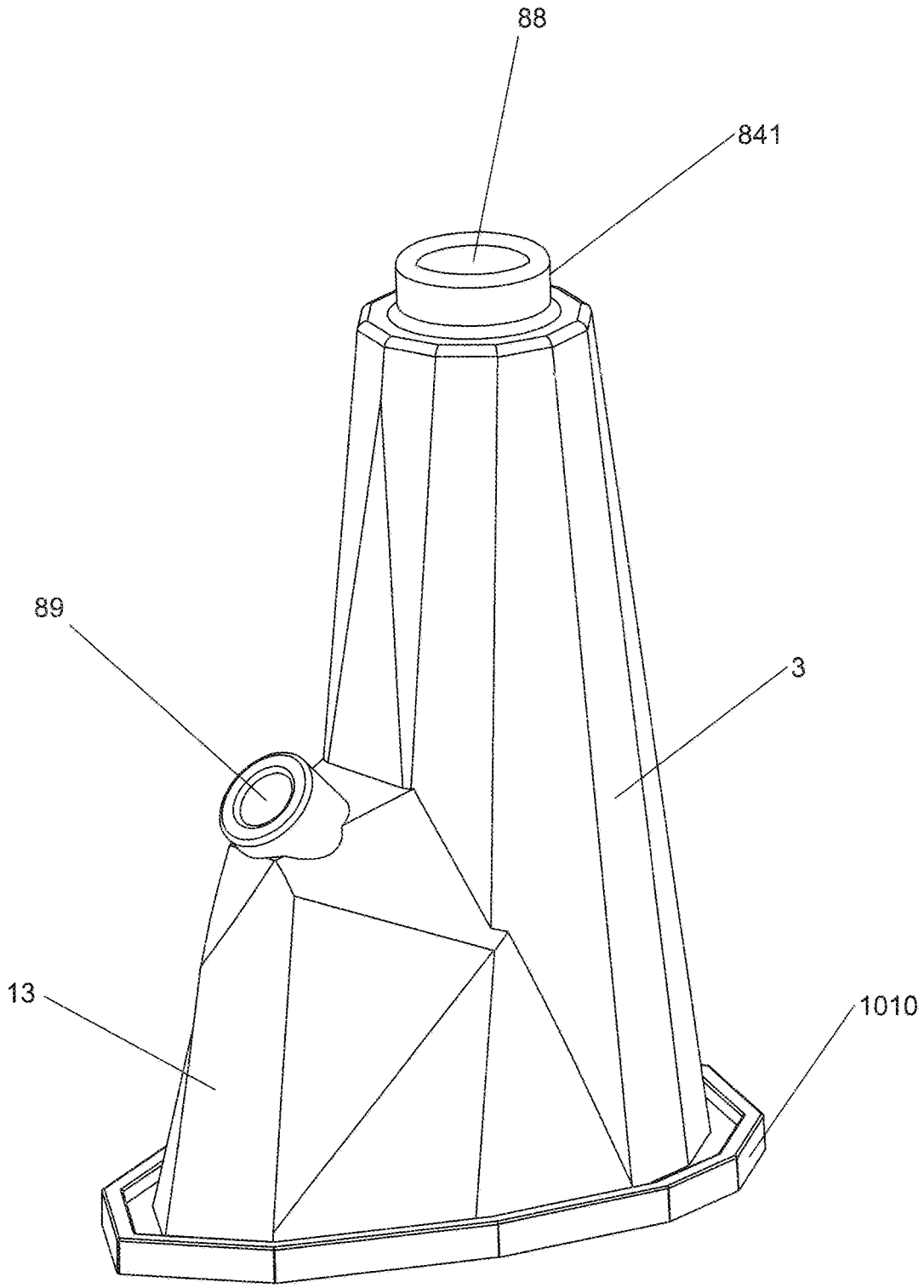
FIG. 8 is a front perspective view of the flexible mold.

In FIG. 8 the ice pipe mold 3 has a top collar 841 to form the support for the mouthpiece 6.

Figure 9:
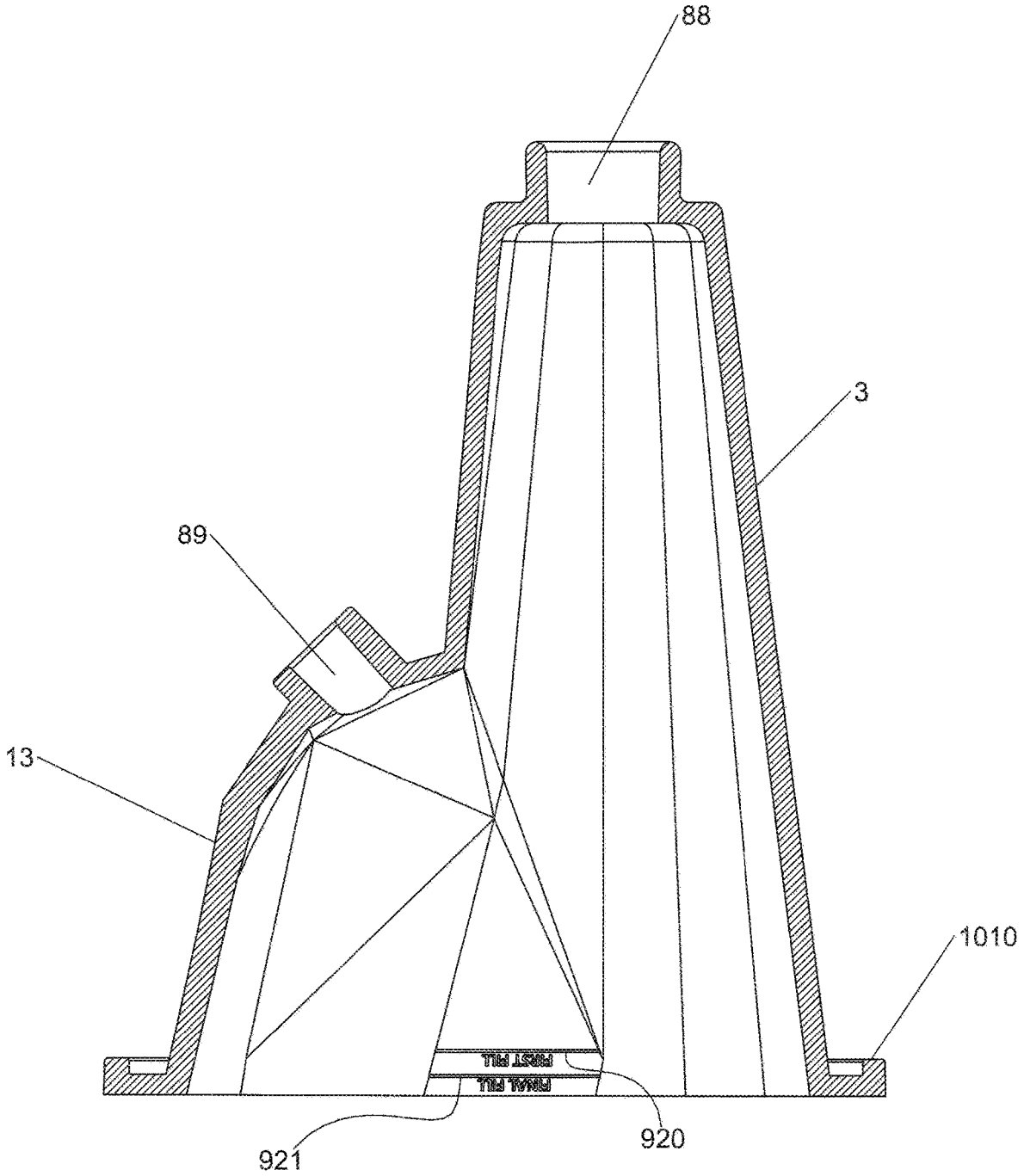
FIG. 9 is a longitudinal sectional view of the flexible mold shown in FIG. 8.

In FIG. 9 the ice pipe mold 3 has a first fill line 920, and a final fill line 921.

Figure 10:
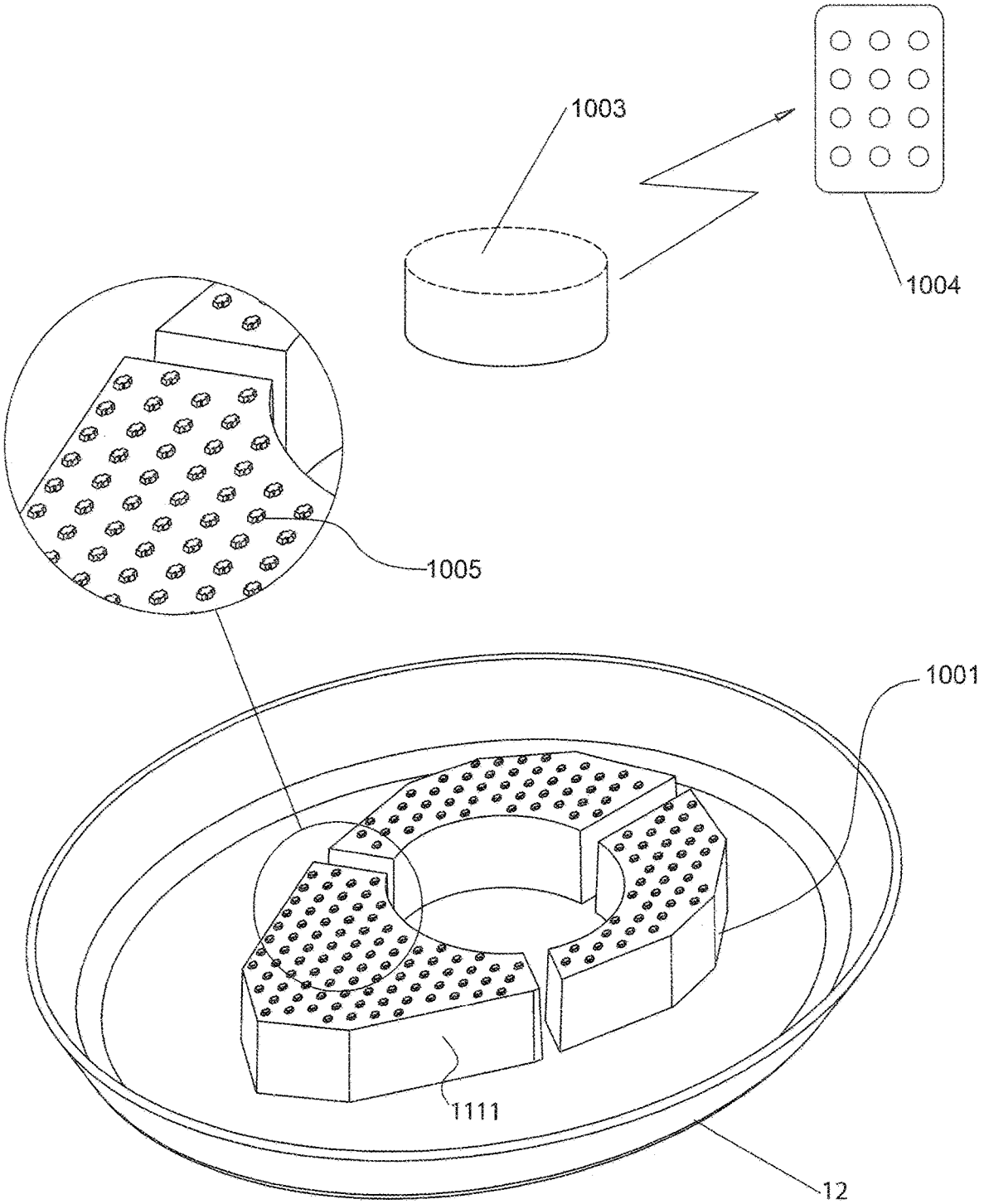
FIG. 10 is a top perspective view of the tray and LED light.
Figure 11:
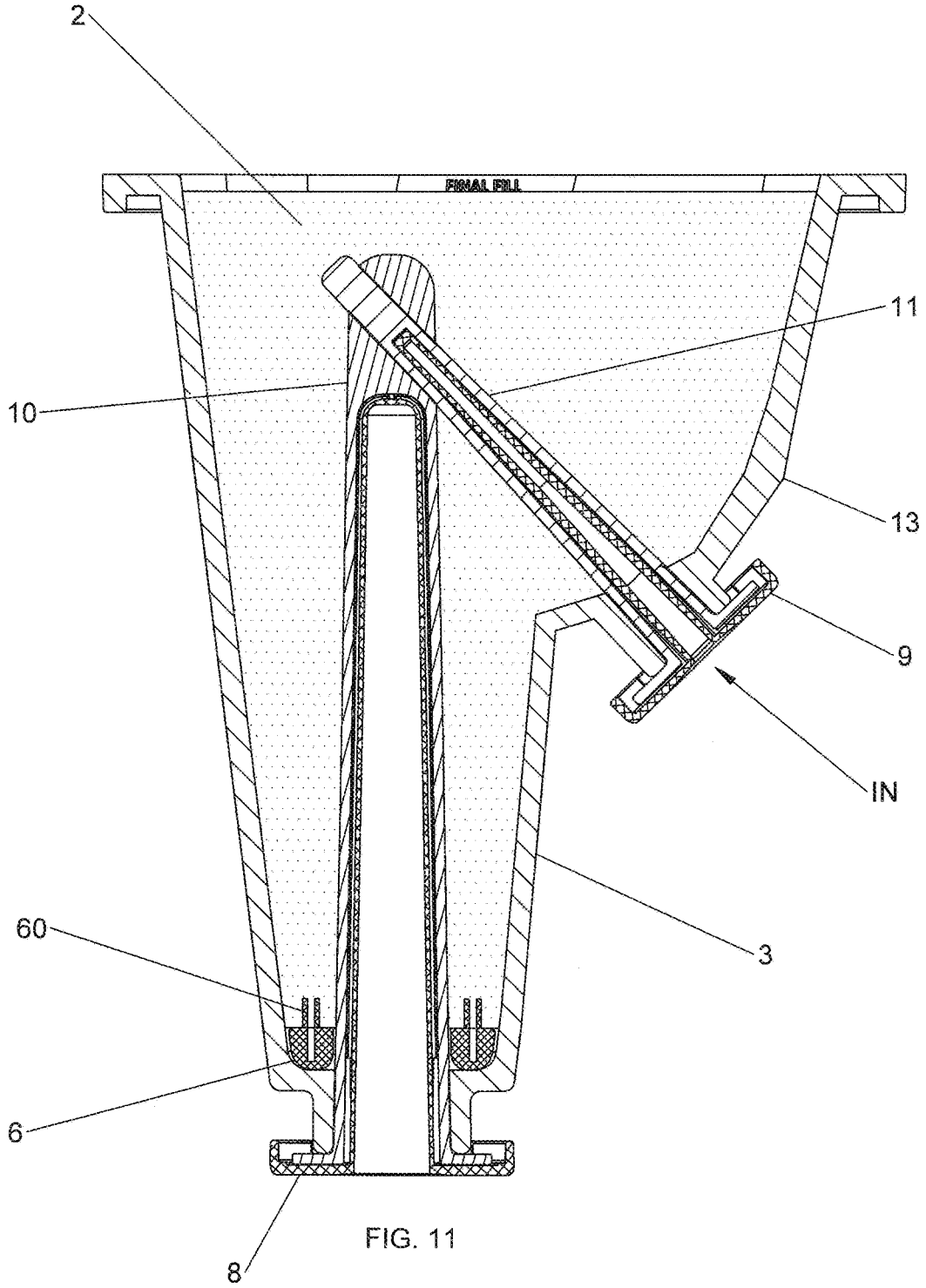
FIG. 11 is a longitudinal sectional view of the pipe mold filled with water in a freezer.

In FIG. 10 the stand (or spill tray) has a central platform 1111 with protrusions 1005 to support the base of the ice pipe 2.

Figure 12:
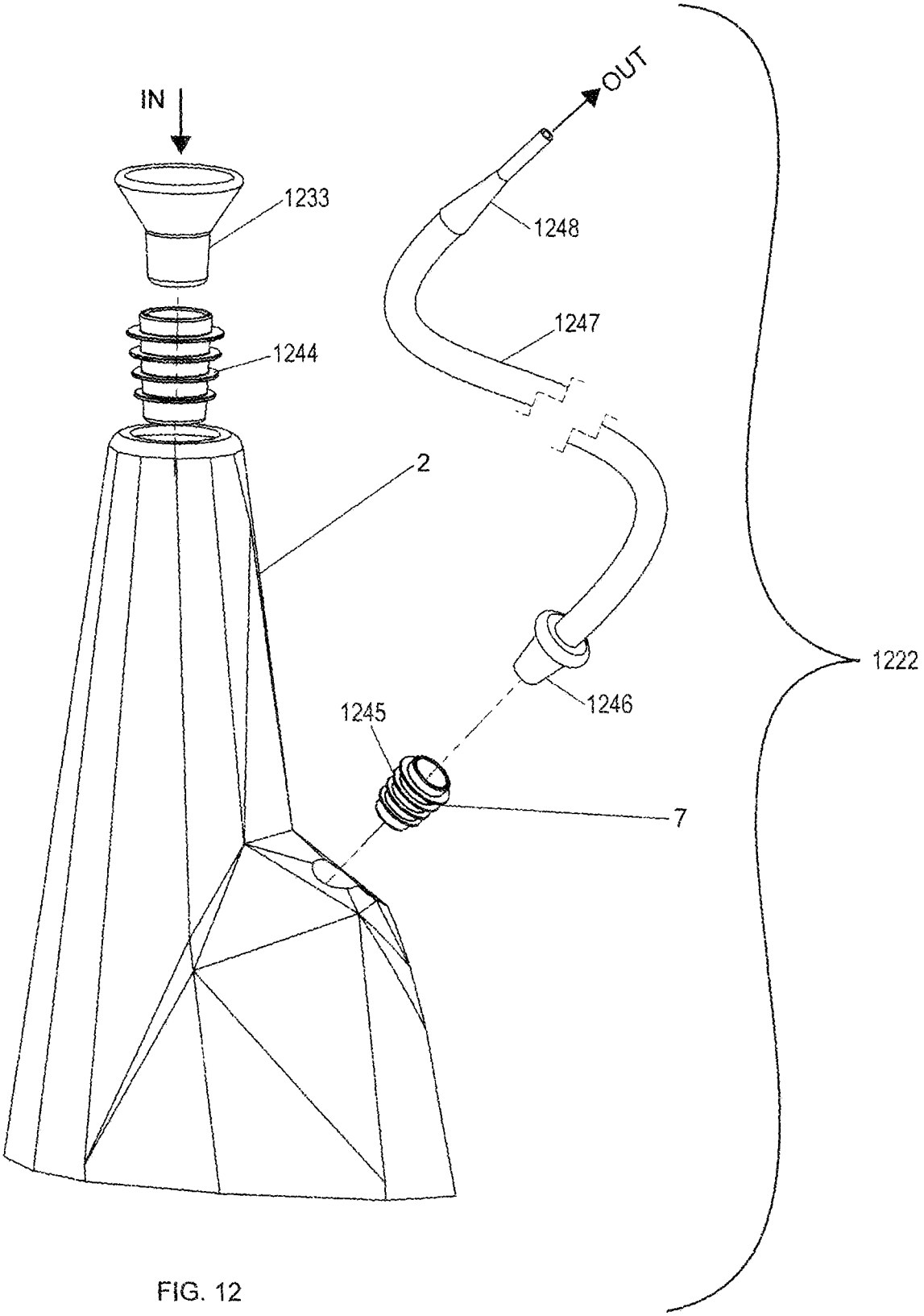
FIG. 12 is a hookah embodiment ice pipe.

Referring next to FIG. 12 a hookah 1222 uses the same ice mold 2 shown in FIG. 2. A burn bowl 1233 burns a material (not shown). The smoke is drawn downward shown by arrow IN. The smoker sucks on mouthpiece 1248 which induces a suction vacuum along tube 1247, nozzle 1246 and receptable 1245. The smoker inhales the smoke shown by arrow OUT.

Although the present invention has been described with reference to the disclosed embodiments, numerous modifications and variations can be made and still the result will come within the scope of the invention. No limitation with respect to the specific embodiments disclosed herein is intended or should be inferred. Each apparatus embodiment described herein has numerous equivalents.

I claim:

1. A flexible mold for making an ice pipe, the flexible mold comprising:

a flexible vertical body having a vertical central hollow and a base with a peripheral outline;

a vertical main sheath removably fitted in the top of the vertical central hollow;

a water port defined by the base with the peripheral outline;

a removable rigid core plug sized to fit in the vertical main sheath;

a removable mouthpiece sized to fit around the vertical main sheath and rest on a top of the vertical body when the flexible mold is upside down;

a smoke bulkhead protruding from the flexible vertical body having a side hole;

a smoke channel insert removably fitted into the side hole of the smoke bulkhead; and a rigid smoke insert removably fitted into the smoke channel insert.

2. The flexible mold of claim 1, wherein the peripheral outline further comprises a ledge.

3. The flexible mold of claim 1, wherein the flexible mold comprises silicone.

4. The flexible mold of claim 1 further comprising a soft collar and glass bowl insertable into an ice pipe formed by the rubberlike mold.

5. The flexible mold of claim 1 further comprising a top collar around the vertical central hollow.

6. The flexible mold of claim 1, wherein the removable rigid core plug further comprises longitudinal grooves.

7. The flexible mold of claim 6, wherein the rigid smoke insert further comprises longitudinal grooves.

8. The flexible mold of claim 7, wherein the removable rigid core plug further comprises a top with a lower surface having air vent ridges.

9. The flexible mold of claim 1, wherein the flexible mold is made of rubber.

10. The flexible mold of claim 1, wherein the flexible mold is made of plastic.

11. The flexible mold of claim 1 further comprising a collar shaped to fit the channel formed by the smoke channel insert.

12. A method to make an ice pipe, the method comprising the steps of:

forming a rubberlike mold comprising a vertical body having a vertical central hollow a base with a peripheral outline;

forming a main sheath removably fittable in the vertical central hollow and having a lower hole;

forming a side smoke sheath fittable into a hole in a side the rubberlike mold;

forming a rigid round mouthpiece sized to slide around the main sheath;

turning the rubberlike mold upside down;

inserting the main sheath into the vertical central hollow;

dropping the mouthpiece onto the main sheath;

inserting the side smoke sheath into the hole in the side of the rubberlike mold and into the hole in the main sheath;

inserting a rigid smoke channel insert into the side smoke sheath so as to fill a hollow in the side smoke sheath;

inserting a rigid main channel insert into the main sheath so as to fill a hollow in the main sheath;

filling the rubberlike mold with water;

freezing the rubberlike mold;

removing the rigid main channel insert and the rigid smoke channel insert;

removing the rubberlike mold from a newly formed ice pipe; and placing a burn bowl on the side hole.

13. The method of claim 12 further comprising the step of placing a bowl adapter on the side hole.

* * * * *